US011342682B2

(12) United States Patent
Pelletti et al.

(10) Patent No.: US 11,342,682 B2
(45) Date of Patent: May 24, 2022

(54) FREQUENCY-SELECTIVE REFLECTOR MODULE AND SYSTEM

(71) Applicant: Metawave Corporation, Palo Alto, CA (US)

(72) Inventors: Chiara Pelletti, Palo Alto, CA (US); Maha Achour, Palo Alto, CA (US)

( * ) Notice: Subject to any disclaimer, the term of this patent is extended or adjusted under 35 U.S.C. 154(b) by 68 days.

(21) Appl. No.: 16/422,921

(22) Filed: May 24, 2019

(65) Prior Publication Data

US 2019/0363447 A1 Nov. 28, 2019

Related U.S. Application Data

(60) Provisional application No. 62/675,917, filed on May 24, 2018.

(51) Int. Cl.
*H01Q 15/14* (2006.01)
*H01Q 1/00* (2006.01)

(52) U.S. Cl.
CPC ..... *H01Q 15/14* (2013.01); *H01Q 1/007* (2013.01)

(58) Field of Classification Search
CPC ..... H01Q 15/14; H01Q 1/007; H01Q 15/0086
See application file for complete search history.

(56) References Cited

U.S. PATENT DOCUMENTS 6,043,790 A 3/2000 Derneryd et al.
6,492,949 B1 12/2002 Breglia et al.
6,650,290 B1 11/2003 Chang et al.
7,250,908 B2 7/2007 Lee
7,847,739 B2 12/2010 Achour et al.
7,928,900 B2 4/2011 Fuller et al.
8,593,819 B2 11/2013 de Rochemont
8,633,866 B2 1/2014 Sarabandi et al.
8,649,742 B2 * 2/2014 Maruyama ..... H01Q 15/14 455/106
8,754,810 B2 6/2014 Guo et al.
8,803,739 B2 8/2014 Rajgopal et al.
9,112,281 B2 8/2015 Bresciani et al.
9,236,892 B2 1/2016 Dupuy et al.
9,545,923 B2 1/2017 Casse et al.
9,905,928 B2 2/2018 de Rochemont
9,972,877 B2 * 5/2018 Casse ..... H01Q 3/36
10,050,344 B2 * 8/2018 Black ..... H01Q 3/46
2011/0175789 A1 7/2011 Lee et al.
2011/0194551 A1 8/2011 Lee et al.
2014/0347234 A1 11/2014 Caloz et al.
(Continued)

OTHER PUBLICATIONS

S. Gupta et al., "Analog Signal Processing in Transmission Line Metamaterial Structures," Radioengineering, vol. 18, No. 2, Poly-Grames Research Center, Quebec, Canada, pp. 155-167, Jun. 2009.
(Continued)

*Primary Examiner* — Daniel D Chang
(74) *Attorney, Agent, or Firm* — Sandra Lynn Godsey

(57) ABSTRACT

Examples disclosed herein relate to a reflector device, having a first conductive layer of substrate, a dielectric layer of substrate, and a second conductive layer patterned with a first and a second set of frequency selective elements configured to reflect an incident electromagnetic radiation beam into a plurality of reflected beams at phase angles different from that of the incident electromagnetic radiation beams.

20 Claims, 8 Drawing Sheets

(56) References Cited

U.S. PATENT DOCUMENTS

| | | | | |
|---|---|---|---|---|
| 2014/0375525 | A1 | 12/2014 | Shi | |
| 2015/0022407 | A1 | 1/2015 | Piazza et al. | |
| 2015/0022421 | A1 | 1/2015 | Vigano et al. | |
| 2015/0229028 | A1 | 8/2015 | Bily et al. | |
| 2016/0013531 | A1 | 1/2016 | Casse et al. | |
| 2016/0021671 | A1 | 1/2016 | Gulati et al. | |
| 2016/0134022 | A1 | 5/2016 | Alexopoulos et al. | |
| 2016/0233588 | A1 | 8/2016 | Bily et al. | |
| 2016/0359235 | A1* | 12/2016 | Driscoll | G01S 7/03 |
| 2019/0165480 | A1* | 5/2019 | Daniel | H01Q 13/106 |
| 2019/0165850 | A1* | 5/2019 | Achour | H01Q 3/44 |

OTHER PUBLICATIONS

A. Babakhani, "Picosecond Pulse Radiating Arrays in Silicon," presentation, ECE Department, Rice University, pp. 1-72, 2017.
M. Moeini-Fard, et al., "Transmit Array Antenna Using Nonuniform Dielectric Layer," Advances in Wireless Communications and Networks. vol. 3, No. 3, pp. 23-28, Jun. 2017.
C. G. M. Ryan, et al. "A Wideband Transmitarray Using Dual-Resonant Double Square Rings," in IEEE Transactions on Antennas and Propagation, vol. 58, No. 5, pp. 1486-1493, May 2010.
K. Konno, et al., "Beam scanning capability and suppression of endfire radiation of dipole array antennas coupled to two-wire parallel transmission line," vol. 4, No. 12, pp. 1-5. Dec. 8, 2015.
A. Babakhani et al.,"Transmitter Architectures Based on Near-Field Direct Antenna Modulation," in IEEE Journal of Solid-State Circuits, vol. 43, No. 12, pp. 2674-2692, Dec. 2008.
J. Reis, et al. "Two-Dimensional Transmitarray Beamsteering Using Stacked Tunable Metamaterials," Loughborough Antennas & Propagation Conference, Loughborough, UK, pp. 495-499, Nov. 2014.
J. Zhang et al., "OpenMili: A 60 GHz Software Radio Platform With a Reconfigurable Phased-Array Antenna," The Annual International Conference on Mobile Computing and Networking (MobiCom), New York City, NY, Oct. 2016.
C. Tripon-Canseliet, et al., "Contribution of MetaMaterials to Improvement of Scan Performance and Reconfigurability of Phased Array Antennas," International Radar Conference, Lille, France, pp. 1-3, Oct. 2014.
S. Lim et al. "Metamaterial-Based Electronically Controlled Transmission-Line Structure as a Novel Leaky-Wave Antenna with Tunable Radiation Angle and Beamwidth," IEEE Transactions on Microwave Theory and Techniques, vol. 53, No. 1, pp. 161-173, Jan. 2005.
L. Boccia, et al., "Multilayer Antenna-Filter Antenna for Beam-Steering Transmit-Array Applications," IEEE Trans. on Microwave Theory and Techniques, vol. 60, No. 7, pp. 2287-2300, Jul. 2012.
Rohde & Schwarz, "Millimeter-Wave Beamforming: Antenna Array Design Choices & Characterization," Version 2e, pp. 1-28, Oct. 28, 2016.
C. A. Allen et al., "Leaky-waves in a metamaterial-based two-dimensional structure for a conical beam antenna application," 2004 IEEE MTT-S International Microwave Symposium Digest (IEEE Cat. No. 04CH37535), vol. 1, pp. 305-308, 2004.
J.Y. Lau, "Reconfigurable Transmitarray Antennas," Ph.D. dissertation, Dept. of Electrical and Computer Eng., Univ. of Toronto, Toronto, Canada, 2012.
M. Steinhauer et al., "Millimeter-Wave-Radar Sensor Based on a Transceiver Array for Automotive Applications," IEEE Transactions on Microwave Theory and Techniques, vol. 56, No. 2, pp. 1-9, Feb. 2008.
J. Duplicy et al., "MU-MIMO in 4G systems," Submission to EURASIP Journal on Wireless Communications and Networking, MU-MIMO Special Issue, pp. 1-12, Nov. 2010.
M.W. Rousstia, "Switched-beam antenna array design for millimeter-wave applications," Eindhoven University of Technology (TU/e), Stan Ackermans Institute (SAI), Information and Communication Technology (ICT) , Eindhoven, pp. 1-183, Aug. 2011.
A. Ourir, et al., "Electromagnetically Induced Transparency in Symmetric Planar Metamaterial at THz Wavelengths," Photonics, vol. 2, pp. 308-316, Mar. 2015.
S. Bildik et al., "Reconfigurable Folded Reflectarray Antenna Based Upon Liquid Crystal Technology," in IEEE Transactions on Antennas and Propagation, vol. 63, No. 1, pp. 122-132, Jan. 2015.
A.H. Abdelrahman, et al., "Transmission Phase Limit of Multilayer Frequency-Selective Surfaces for Transmitarray Designs," IEEE Trans. on Antennas and Propagation, vol. 62, No. 2, pp. 690-697, Feb. 2014.

* cited by examiner

FREQUENCY-SELECTIVE REFLECTOR MODULE AND SYSTEM

CROSS-REFERENCE TO RELATED APPLICATIONS

This application claims priority to U.S. Provisional Application No. 62/675,917, filed on May 24, 2018, and incorporated herein by reference in their entirety.

BACKGROUND

New generation wireless networks are increasingly becoming a necessity to accommodate user demands. Mobile data traffic continues to grow every year, challenging the wireless networks to provide greater speed, connect more devices, have lower latency, and transmit more and more data at once. Users now expect instant wireless connectivity regardless of the environment and circumstances, whether it is in an office building, a public space, an open preserve, or a vehicle. In response to these demands, a new wireless standard known as 5G has been designed for deployment in the near future. The 5G standards extend operations to millimeter wave bands, which covers frequencies between beyond 6 GHz, and to planned 24 GHz, 26 GHz, 28 GHz, and 39 GHz, and up to 300 GHz, all over the world.

The millimeter wave spectrum provides narrow wavelengths in the range of ~1 to 10 millimeters that are susceptible to high atmospheric attenuation and have to operate at short ranges (just over a kilometer). In dense-scattering areas such as with street canyons or indoor office buildings, blind spots may exist due to multipath, shadowing and geographical obstructions. In remote areas where the ranges are larger, extreme climatic conditions with heavy precipitation may prevent operators from using large array antennas due to strong winds and storms. These and other challenges in providing millimeter wave wireless communications impose ambitious goals on system design, including the ability to generate desired beam forms at a controlled direction while avoiding interference among the many signals and structures of the surrounding environment.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout, and wherein.

DETAILED DESCRIPTION

A frequency-selective reflector module and system is disclosed. The frequency-selective reflector module reflects a wireless signal to connect with devices, such as User Equipment ("UE"), that are operational in complicated environments, including indoors with walls and constructs, and where there are other non-line-of-sight areas. The reflector module disclosed herein is able to receive a broadcast signal from a transmitter such as a Base Station ("BS") and generate directed transmissions through multiple paths and having different transmission beams so as to a non-line-of-sight-UE ("NUE"). The ability to initiate a directed transmission with multiple devices provides a way for a network operator to provide ubiquitous coverage, and vastly improve coverage.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
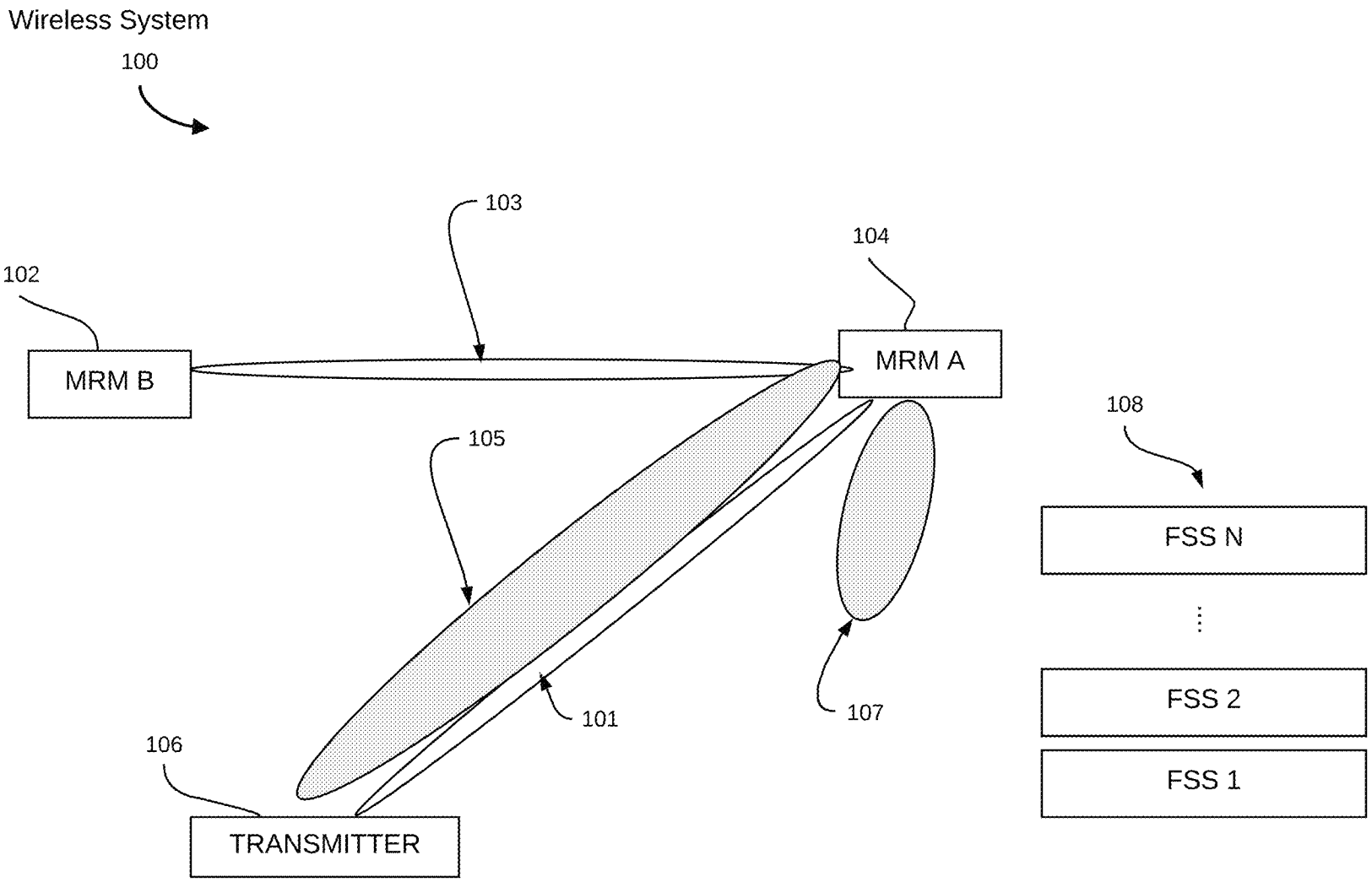
FIG. 1 illustrates a wireless communication environment having multiple Meta-Structure Reflector Modules ("MRMs"), according to various examples.

FIG. 1 illustrates a wireless system 100 having a transmitter 106 capable of multiple transmissions throughout an environment. The transmitter 106 communicates with one or more Meta-Structure Reflector Module(s), which in this illustration includes MRM_A 104 and MRM_B 102. The reflectors are positioned for coverage within an environment. MRM_A 14 includes multiple layers of Frequency-Selective Substrate ("FSS") wherein at least one layer reflects signals at a first frequency, $f_1$, allowing signals at a second frequency, $f_2$, to pass through. Signals at $f_2$ are then reflected by another layer within MRM_A 14. There may be any number of FSS layers within MRM_A.

In operation, transmitter 106 generates a signal 101 at frequency $f_1$ directed to reflector MRM_A 104, which is configured to reflect this signal to MRM_B 102 as signal 103. Transmitter 106 may also generate a signal 105 at frequency $f_2$ directed to reflector MRM_A 104, which is reflected by an FSS layer within MRM_A 104 as signal 107. The specific reflection parameters in some examples are fixed and MRM_A 104 is a passive device. In other examples, the reflection parameters may be adjusted by active circuitry enabling control of the reflected beam forms and directivity of the MRM_A 104. Transmitter 106 is also adapted to transmit additional signals at other frequencies not shown. As illustrated, MRM_A 104 includes multiple FSS layers 108, wherein each FSS layer allows frequencies to pass through while reflecting other frequencies. In this way, MRM_A 104 may be configured to enable multiple frequency paths. While described with respect to a cellular system for clarity of understanding, the reflector modules disclosed herein are applicable in other wireless systems where obstacles and environmental features impede communications resulting in non-line-of-sight areas or dead zones.

Figure 2:
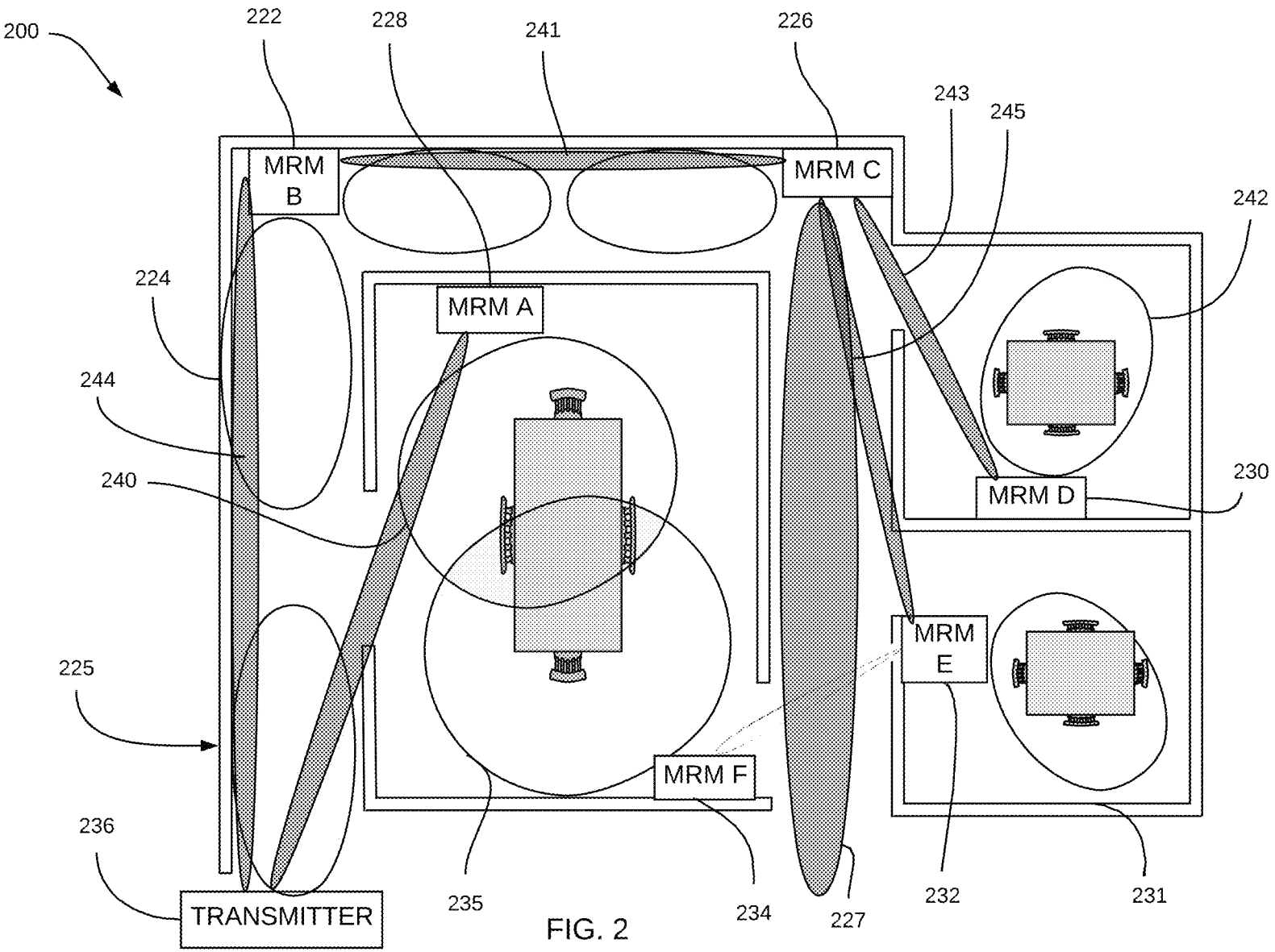
FIG. 2 illustrates a wireless system in an indoor environment, according to various examples.

Continuing with FIG. 2, an environment is pictured with a variety of constructs. In this situation, transmitter 236 is positioned on an exterior opening of the environment 200 and transmits signals at multiple frequencies and having directivity coordinated with other modules within environment 200, including MRM_A through MRM_F, each positioned so as to provide coverage within the various rooms and hallways. Transmitter 236 generates signals 224 and 240 to MRM_B 222 and MRM_A 228, respectively. The MRM_A 228 generates signal 240 within which the signal is received. In some applications, this is defined as the area where the signal is within 3 dB of its maximum response amplitude. The configuration illustrated provide coverage to the spaces of the hallways with signals 224, 225, 227, and provides coverage to the rooms with signals 242, 231, 240 and 235.

Inter-reflector signals 244, 240, 241, 243 and 245 provide a path from the transmitter 236 to individual MRMs. In this way, the transmitter sends signal 244 to MRM_B 222, which then reflects that information in signal 241 to MRM_C 226. The next leg is for MRM_C 226 to reflect signals 243 and 245 to MRM_D 230 and MRM_E 232, respectively. MRM_E 232 also reflects a signal to MRM_F 234. There a variety of configurations possible to enable reflection of the original transmission. While the MRMs of environment 200 are passive devices, in alternate examples, these may be active devices which are able to amplify the signals reflected or retransmitted. Similarly, each of the MRMs may be part of a transceiver module, similar to transmitter 236, wherein the MRM may generate signals, respond to signals received and control beam formation.

Transmission from transmitter 236 may be in progress with UE not shown or in the process of initiating a communication, such as hand off from another BS (not shown) or starting a new call. These transmissions are impeded by obstacles, including buildings and structures. Some of the obstacles include walls on the perimeter and internal areas of environment 200, which create Non-Line-of-Sight ("NLS") areas, which may be referred to as "dead zones." To achieve universal coverage, a Meta-Structure Reflector Module ("MRM") is positioned proximate transmitter 236 but having access to the dead zone of that base station, such as around a corner or in a room. The MRM_B 222 and others perform a reflector-type operation to provide coverage within these dead zones. The reflector-type operation is similar to a repeater or other device to extend the wireless range/reach of a wireless transmitter.

In the present example, the MRM_B 222 is a passive device, wherein the behavior of the antenna is configured for specific directed transmissions. For an active MRM, reflection is enhanced by beam forming through control of the reactance of one or more transmission line paths within the MRM; this modification of the FSS behavior, such as to modify the behavior of a Meta-Structure ("MTS") unit cell, changes the beam shape, direction, size, and parameters. In operation, an active MRM receives transmissions, determines the control to apply to generate one or more directed beams and thereby extends the reach of a transmitter or BS.

The environment 200 may include any of a variety of different transmission mechanisms, such as a Wi-Fi transmission unit, and so forth. These may be reflected by an MRM in some applications. Note, the dead zone is determined by the environment, the wireless system capabilities, and obstacle configurations. Similarly, a dead zone may be a combination of multiple distinct and separate areas, wherein an MRM is configured to transmit signals within these multiple areas.

Figure 3:
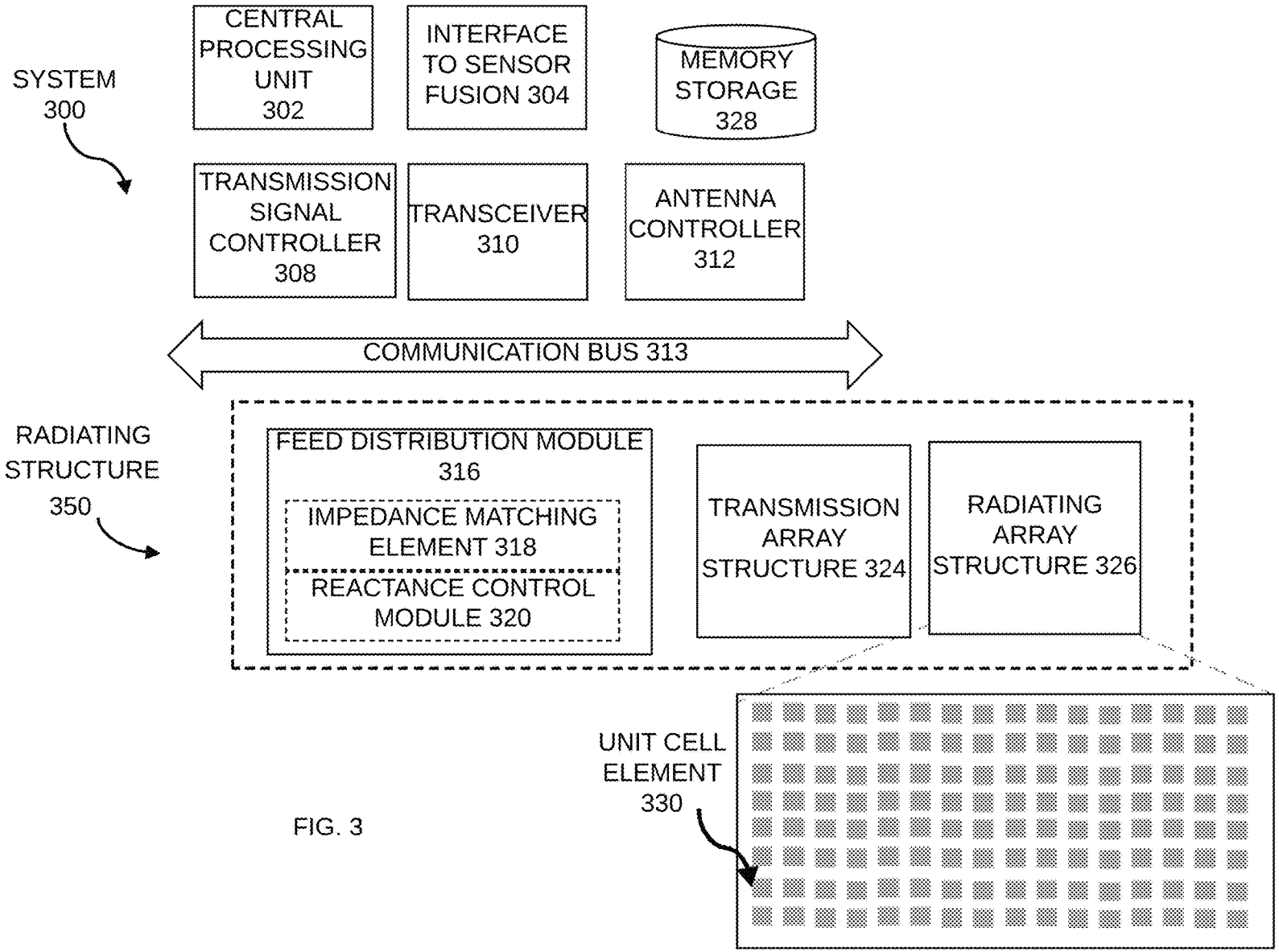
FIG. 3 illustrates a wireless system, according to various examples.

Attention is now directed to FIG. 3, which illustrates an example configuration of an MRM. This example configuration is not meant to be limiting and is applicable to many different applications, including, for example, in vehicular radar modules, 5G communications, fixed wireless, and so on. MRM 100 is an antenna system that includes modules such as radiating structure 350 coupled to an antenna controller 312, a central processor 302, and a transceiver 310. A signal is provided to antenna system 300 and the transmission signal controller 308 may act as an interface, translator or modulation controller, or otherwise as required for the signal to propagate through antenna system 300.

The transmission signal controller 308 may generate a cellular modulated signal, such as orthogonal frequency division multiple ("OFDM") signal. In some examples, the signal is provided to the antenna system 300 and the transmission signal controller 308 may act as an interface, translator or modulation controller, or otherwise as required for the signal to propagate through a transmission line system.

The present invention is described with respect to a communication system, where the radiating structure 3500 is a structure having a feed structure with an array of transmission lines feeding a radiating array. The transmission line has various portions, wherein a first portion receives a transmission signal as an input, such as from a coaxial cable or other supply structure, and the transmission signal traverses a substrate portion to divide the transmission signal through a feed-style network resulting in multiple transmission lines that feed multiple super elements. Each super element includes a transmission line having a plurality of slots. The transmission signal radiates through these slots in the super elements of the transmission array to an array of MTS elements positioned proximate the super elements. In various examples presented herein, the MTS array is overlaid on the super elements, but a variety of configurations may be implemented. The super elements effectively feed the transmission signal to the MTS array elements, from which the transmission signal radiates. Control of the MTS array elements results in a directed signal or beam form.

In operation, the antenna controller 312 receives information from other modules in antenna system 300 indicating a next radiation beam, wherein a radiation beam may be specified by parameters such as beam width, transmit angle, transmit direction and so forth. The antenna controller 312 determines the direction, power, and other parameter of the beams and controls the radiation structure 350 to achieve beam steering in various directions. The antenna controller 312 also determines a voltage matrix to apply to capacitance control mechanisms coupled to the radiating structure 350 to achieve a given phase shift. In some examples, the radiating array structure 326 is adapted to transmit a directional beam without incorporating digital beam forming techniques, but rather through active control of the reactance parameters of the individual elements that make up the radiating array structure 326.

Transceiver 310 prepares a signal for transmission, which is transmitted and received by each element of the radiating structure 350 and the phases of radiating patterns generated by the radiating array structure 326 is controlled by the antenna controller 312. In various examples, transmission signals are received by a portion, or subarray, of the radiating array structure 326. These radiating array structures 326 are applicable to many applications, including radar in autonomous vehicles to detect objects in the environment of the car, or in wireless communications, medical equipment, sensing, monitoring, and so forth. Each application type incorporates designs and configurations of the elements, structures and modules described herein to accommodate their needs and goals.

Radiating structure 326 includes a feed distribution module 316 coupled to a transmission array structure 324 for transmitting signals through radiating array structure 326, which generates controlled radiation beams. The present examples enable extension of a wireless communication system in a variety of areas and configurations. In various examples, feed distribution module 316 has a plurality of transmission lines configured with discontinuities within a conductive material and having a lattice structure of unit cell radiating elements proximate a set of transmission lines. The feed distribution module 316 includes a coupling module for providing an input signal to the transmission lines, or a portion of the transmission lines. In some examples, the coupling module is a power divider structure that divides the signal among the plurality of transmission lines, wherein the power may be distributed equally among the N transmission lines or may be distributed according to another scheme, wherein the N transmission lines do not all receive a same signal strength.

The feed distribution module 316 has an impedance matching element 318 and a reactance control module 320. The reactance control module 320 is capable of modifying a capacitance of the radiating array structure 350. The impedance matching element 318 may be configured to match the input signal parameters with radiating elements, and therefore, there are a variety of configurations and locations for this element, which may include a plurality of components. In one example, the impedance matching element 318 includes a directional coupler having an input port to each of adjacent transmission lines. The adjacent transmission lines and the impedance matching element 318 form a super element, wherein the adjacent transmission line pair has a specific phase difference, such as a 90° phase difference with respect to each other.

The impedance matching element 318 works in coordination with the reactance control element 320 to provide phase shifting of the radiating signal(s) from radiating array structure 326. In various examples, reactance control module 320 includes a reactance control mechanism controlled by antenna controller 312, which may be used to control the phase of a radiating signal from radiating array structure 326 and to adjust the effective reactance of a transmission line and/or a radiating element fed by a transmission line. Reactance control module 320 may, for example, include a phase shift network system (not shown) to provide any desired phase shift up to 360°. The phase shift network system may include multiple varactors to achieve the desired phase shift.

A varactor diode acts as a variable capacitor when a reverse bias voltage is applied. As used herein, the reverse bias voltage is also referred to herein as reactance control voltage or varactor voltage. The value of the reactance, which in this case is capacitance, is a function of the reverse bias voltage value. By changing the reactance control voltage, the capacitance of the varactor diode is changed over a given range of values. Alternate examples may use alternate methods for changing the reactance, which may be electrically or mechanically controlled. In some examples, a varactor diode may also be placed between conductive areas of a radiating element. With respect to the radiating element, changes in varactor voltage produce changes in the effective capacitance of the radiating element. The change in effective capacitance changes the behavior of the radiating element and in this way the varactor may be considered as a tuning element for the radiating elements in beam formation.

The reactance control mechanism enables control of the reactance of a fixed geometric transmission line. One or more reactance control mechanisms may be placed within a transmission line. Similarly, reactance control mechanisms may be placed within multiple transmission lines to achieve a desired result. The reactance control mechanisms may have individual controls or may have a common control. In some examples, a modification to a first reactance control mechanism is a function of a modification to a second reactance control mechanism.

It is appreciated that the impedance matching element 318 and the reactance control element 320 may be positioned within the architecture of feed distribution module 316. Alternatively, one or both of impedance matching element 318 and reactance control element 320 may be external to the feed distribution module 316 for manufacture or composition as an antenna.

For structures incorporating a dielectric substrate to form a transmission path, such as a substrate integrate waveguide ("SIW"), reactance control may be achieved through integration with the transmission line, such as by inserting a microstrip or strip line portion that will support the reactance control module 320. Where there is such an interruption in the transmission line, a transition is made to maintain signal flow in the same direction. Similarly, the reactance control module 320 may require a control signal, such as a DC bias line or other control means, to enable the antenna system 100 to control and adjust the reactance of the transmission line. Some examples may include a structure(s) that acts to isolate the control signal from the transmission signal. In the case of an antenna transmission structure, the isolation structure may be a resonant control module that serves to isolate DC control signal(s) from AC transmission signals.

Antenna system 300 includes radiating structure 350, such as for cellular antennas, and provides enhanced phase shifting of the transmitted signal. Antenna system 300 reduces the computational complexity of the system and increases the transmission speed. Antenna system 300 accomplishes these goals by taking advantage of the properties of hexagonal structures coupled with novel feed structures. In some examples, antenna system 300 accomplishes these goals by taking advantage of the properties of MTS structures coupled with novel feed structures. A metastructure, as generally defined herein, is an engineered, non- or semi-periodic structure that is spatially distributed to meet a specific phase and frequency distribution. In various examples, the MTS cells may be configured into subarrays that have specific characteristics. Each subarray may be configured to reflect signals at a specific angle.

As illustrated, radiating structure 350 includes the radiating array structure 326, composed of individual radiating cells such as cell 330. The radiating array structure 326 may take a variety of forms and is designed to operate in coordination with the transmission array structure 324, wherein individual radiating cells (e.g., cell 330) correspond to elements within the transmission array structure 324. As illustrated, the radiating array structure 326 is an array of unit cell elements (e.g., an 8×16 array), wherein each of the unit cell elements has a uniform size and shape; however, some examples may incorporate different sizes, shapes, configurations and array sizes. When a transmission signal is provided to the radiating structure 324, such as through a coaxial cable or other connector, the signal propagates through the feed distribution module 316 to the transmission array structure 324 and then to radiating array structure 326 for transmission through the air.

MTS unit cells include a variety of conductive structures and patterns, such that a received transmission signal is radiated therefrom. The MTS unit cell (e.g., cell 330) acts as an artificial material, meaning a material that is not naturally occurring. The MTS array in radiating array structure 326 is a periodic arrangement of unit cells that are each smaller than the transmission wavelength. In some examples, the MTS cells may be metamaterial ("MTM") cells. Each MTM cell has some unique properties. These properties include a negative permittivity and permeability resulting in a negative refractive index; these structures are commonly referred to as left-handed materials ("LHM"). The use of LHM enables behavior not achieved in classical structures and materials, including interesting effects that may be observed in the propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite and other applications.

The metamaterial antennas may take any of a variety of forms, some of which are described herein for comprehension; however, this is not an exhaustive compilation of the possible implementations of antenna system 300. Metamaterials are typically arranged in repeating patterns. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement and so forth result in the smart properties capable of manipulating EM waves by blocking, absorbing, enhancing, or bending waves.

Figure 4:
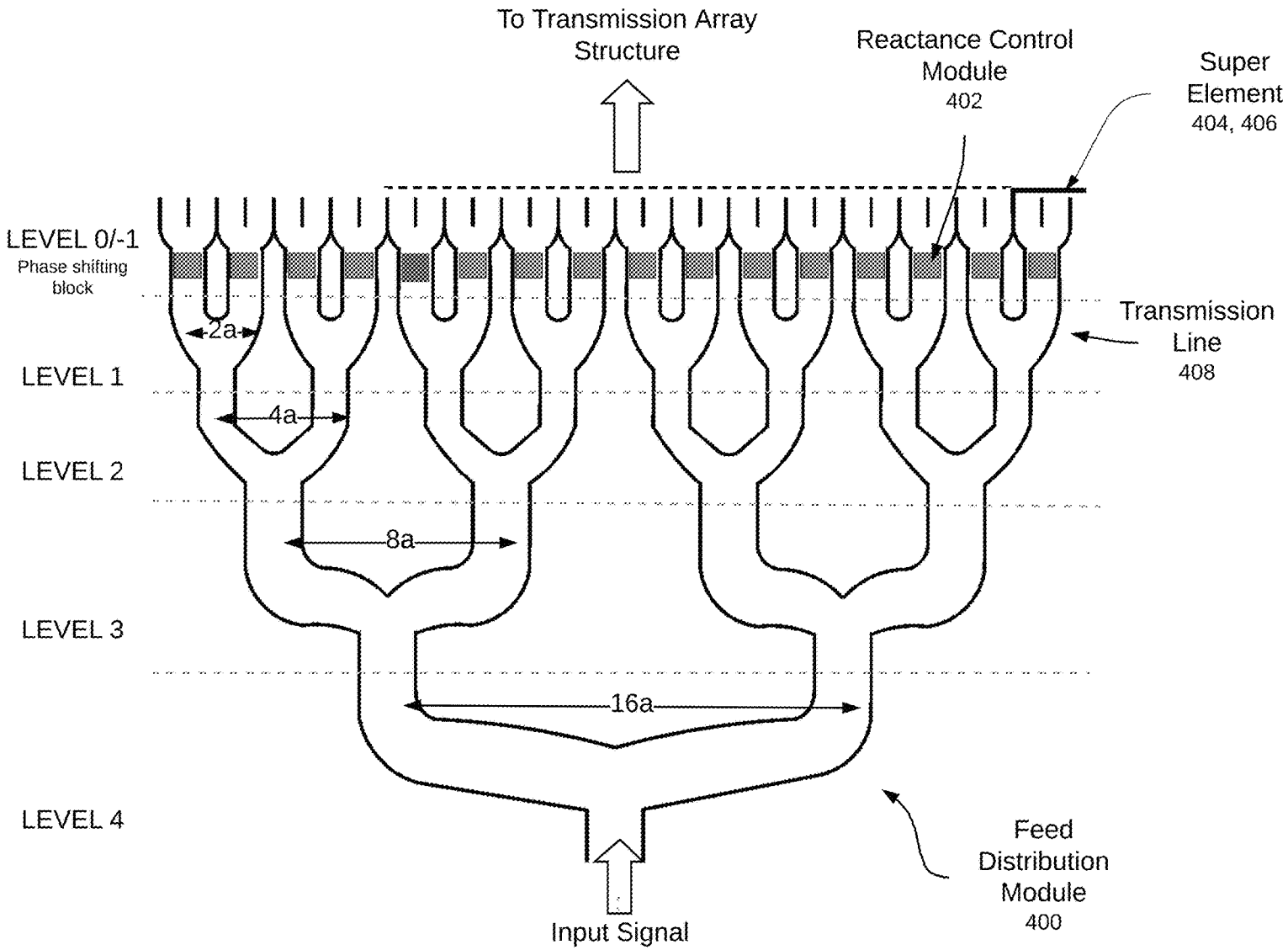
FIG. 4 illustrates a corporate feed for an MRM, according to various examples.

As shown in FIG. 4, feed distribution module 400 provides a corporate feed dividing the transmission signals received for propagation to multiple super elements. In this example, the feed distribution module 400 is a type of power divider circuit. The input signal is fed in through the various paths. This configuration is an example and is not meant to be limiting to the specific structure disclosed.

Within the feed distribution module 400 is a network of paths, wherein each of the division points is identified according to a division level. The feed distribution module 400 receives input signals, which propagate through the network of paths to the transmission array structure 324 as shown in FIG. 3. In this example, the paths have similar dimensions; however, the size of the paths may be configured to achieve a desired transmission and/or radiation result. In the present example, the transmission line 408, or path portion, is at LEVEL 1, which is the level of paths feeding the super elements of the transmission array structure 324. The transmission line 408 includes a reactance control module 402, which acts to change the reactance of the transmission line resulting in a change to the signal propagating through the transmission line 144 to the super elements 404, 406. There are a variety of ways to couple the reactance control module 402 to one or more transmission lines. As illustrated, the other paths of LEVEL 1 have reactance control mechanisms that may be the same as the mechanism provided by reactance control module 402.

The transmission lines are formed in the substrate of the radiating structure 350 of FIG. 3. Transmission line 408 is a part of super element 404 that is split into two transmission lines. The reactance control module 402 is configured on a microstrip within the transmission line structure. Note that the reactance control module 402 may be positioned between transmission lines or may be positioned otherwise within the paths leading to super elements 404, 406.

Figure 5:
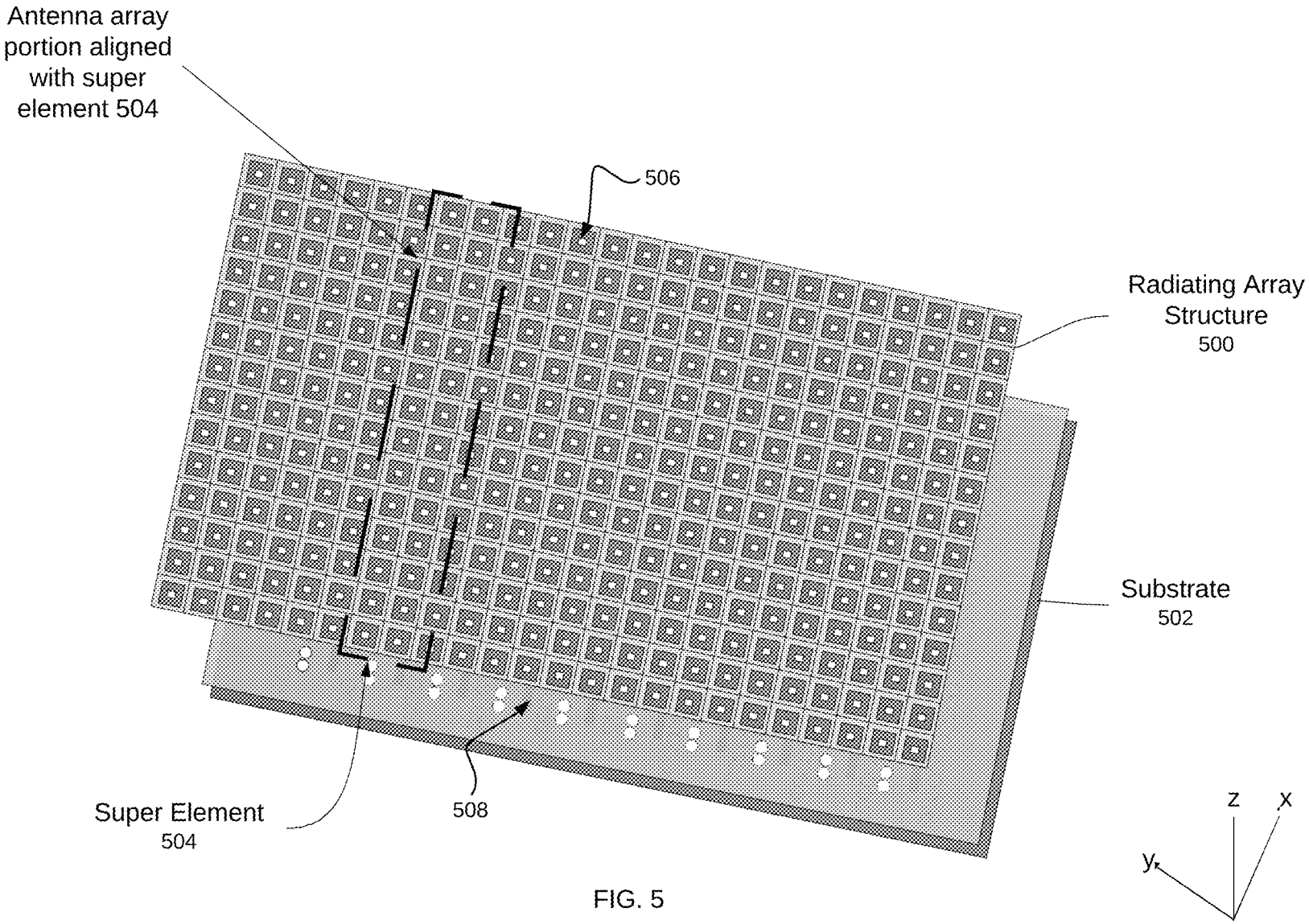
FIG. 5 illustrates layers of an MRM, according to various examples.

FIG. 5 illustrates a top view of a layer of radiating structure 350 which is part of the transmission array structure 324 within radiating structure 350, according to some examples. The radiating structure 350 is a composite substrate, having multiple conductive layers with at least one dielectric layer there between. A material for the substrate 502 is designed with specific parameters, such as low dielectric loss, and may include a Rogers material. In some examples, the material is chosen to be applicable to high frequency circuits. Transmission lines are configured for propagation of a transmission signal from the input to each transmission line and built in the substrate and layers.

As illustrated in FIG. 5, a pair or set of transmission lines forms a super element of slotted transmission lines 504. The signal propagates through the super elements 504, radiating through discontinuities in the conductive surface of substrate 502. The radiating array structure 326 is positioned proximate the conductive surface and includes the MTS cells that receive the signals therefrom and generate the transmission beams. Each MTS cell 506 is designed and configured to support the specified radiation patterns. In this example, the MTS array in the radiating array structure 326 is configured to overlay the conductive surface. This portion of the transmission array structure 324 includes multiple super elements 504, each of which behave as a slotted wave guide to feed the radiating unit cell elements.

The antenna structure of FIG. 3 may be referred to as a type of slotted wave guide antenna ("SWGA"), wherein the SWGA acts as a feed to the radiating array structure 326. The SWGA portion may include the following structures and components: a full ground plane, a dielectric substrate, a feed network, such as direct feeds to the multi-ports transceiver chipset, an array of antenna or complementary antenna apertures, such as a slot antenna, to couple the electromagnetic field propagating in the Substrate Integrated Waveguide ("SIW") with meta-structures located on top of the antenna aperture. The feed network may include passive or active lump components for matching phase control, amplitude tampering, and other RF enhancement functionalities. The distances between the meta-structures can be much lower than half the wavelength of the radiating frequency of the transmission signal. Active and passive components may be placed on the meta-structures with control signals either routed internally through the radiating structure 350 or externally through or on upper portions of the substrate.

Alternate examples may reconfigure and/or modify the radiating structure 350 to improve radiation patterns, bandwidth, side lobe levels, and so forth. The SWGA loads the meta-structures to achieve the desired results. The antenna performance may be adjusted by design of the radiating structure 350 features and materials, such as the shape of the slots, slot patterns, slot dimensions, conductive trace materials and patterns, as well as other modifications to achieve impedance matching and so forth. The substrate has two portions of dielectric separated by a slotted transmission line positioned there between. The slotted transmission line sits on a substrate 502, wherein each transmission line is within a bounded area; the boundary is a line of vias cut through the conductive layer. The slots are configured within the conductive layer and spaced as illustrated in FIG. 5, where in the present example the slots 508 are positioned symmetrically with respect to the center line. For clarity of understanding, FIG. 5 illustrates the slots as equidistant from a center line, such as centerline, where slots 508 are on opposite sides of the centerline but are equidistant to the center line and staggered along the direction thereof. Each bounded transmission line is referred to herein as a "super element" such as super element transmission lines 504.

Figure 6:
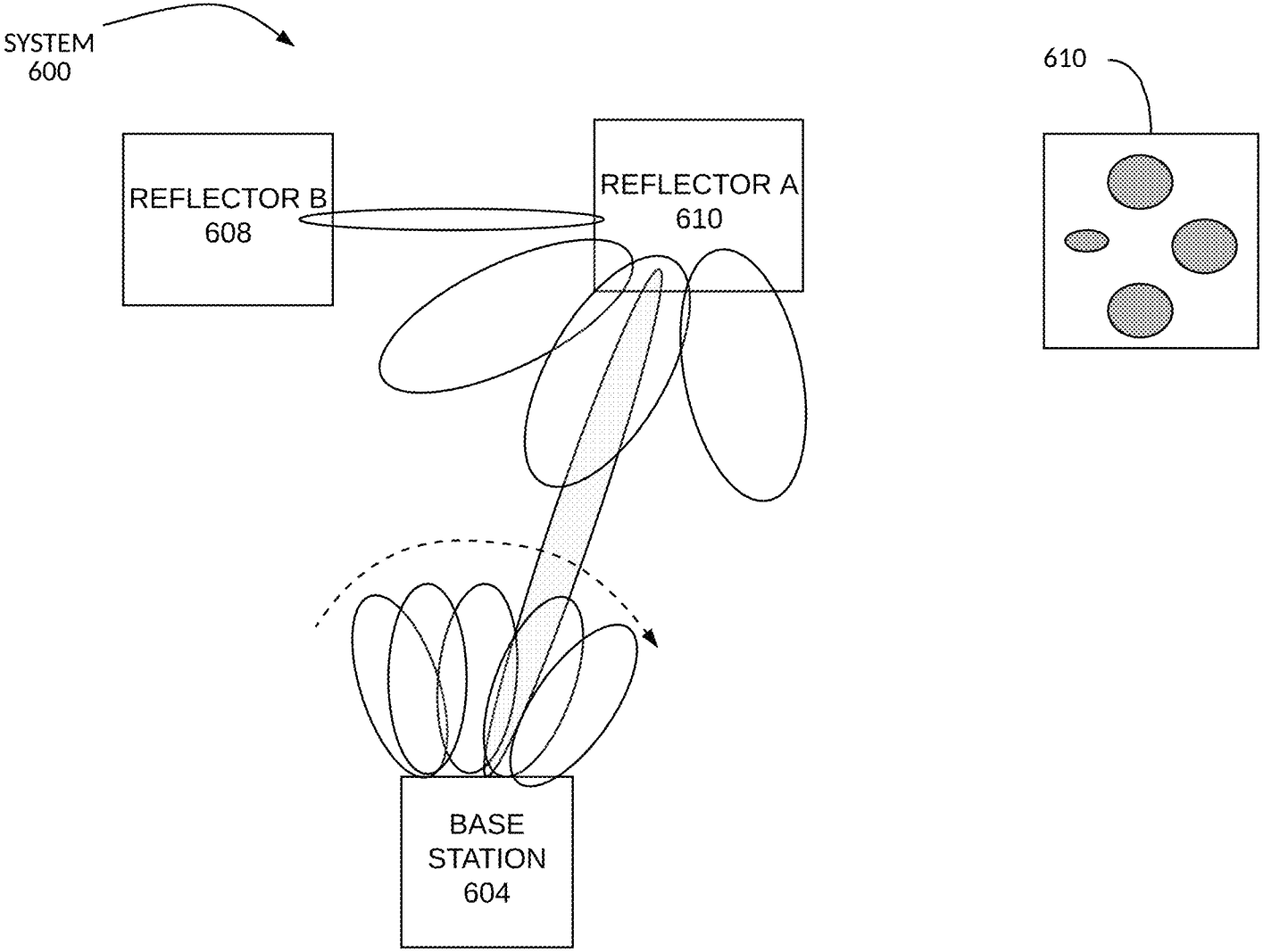
FIG. 6 illustrates a wireless system having multiple reflectors, according to various examples.

FIG. 6 illustrates a system 600 having multiple reflectors. The reflector 610 has a configuration of at least one FSS layer that is able to generate multiple beamforms. The base station 604 transmits a signal to the reflector 610 and other transmissions. The transmissions received by reflector 610 are reflected by reflector 610, which in the present example is a passive device, meaning that there is no active control of the FSS layer. Alternate examples may implement an active circuit design for flexibility and control. Reflector 610 reflects the received signal as four separate beams, wherein one beam is a connection beam to reflector 608 and the other three beams are to provide coverage for the area proximate the reflector 610. The reflector 610 is further illustrated in the z-direction which is the direction of the beamforms. Looking into the reflector 610 there are four beams illustrated, corresponding to the beamform patterns of system 600.

In some examples, a reflector such as reflector 610 is an MRM having a single layer of MTM unit cells configured to enable the reflection of a received transmission into the four different beamforms illustrated. In some examples, the MTM unit cells include a reactance control mechanism, such as a varactor, wherein the MRM is an active device and there is electronic control of the reactance control mechanisms.

Note that a base station is illustrated in FIG. 6, however, there are a variety of components that facilitate wireless communication between a device, such as a UE, and a network. The network may be any of a variety of wireless protocol networks, including cellular, Wi-Fi, WAN, and so forth. The base station may also be referred to as a node B or eNB, such as in cellular network. The base station provides transmission and reception of signals.

Figure 7:
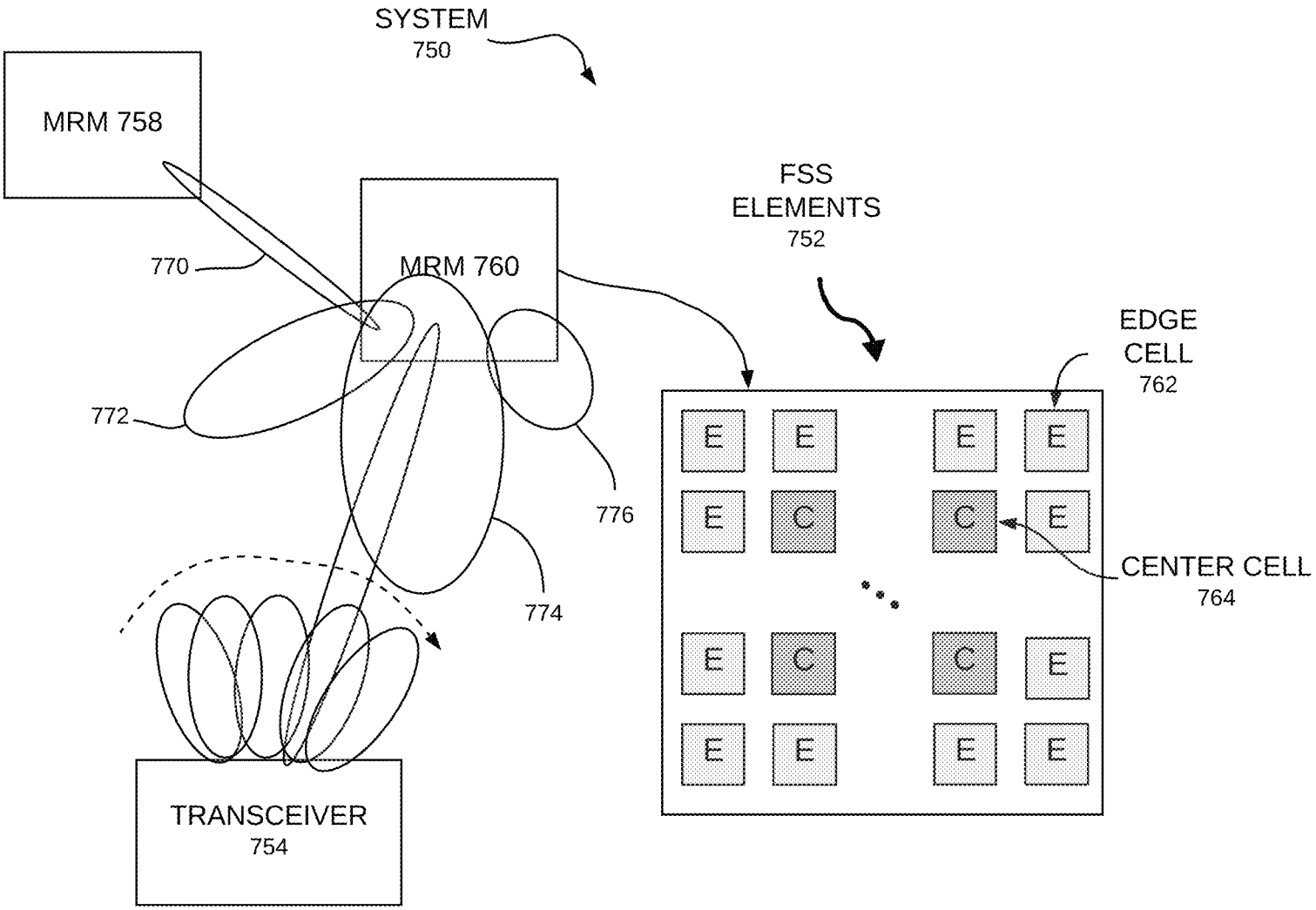
FIGS. 7 and 8 illustrate a wireless system having multiple MRMs, according to various examples.

FIG. 7 illustrates an example of a system 750 with multiple MRMs. A transceiver 754 transmits signals within system 750, which includes MRM 760 and MRM 758, which are effectively coupled by wireless signals in series. The transceiver 754 transmits a signal to MRM 760, a portion of which is reflected to MRM 758 as a connection reflection 770 and other portions are reflected as transmissions 772, 774 and 776. In examples where the MRM 760 is an active device, the directivity and beamforms may be adjusted according to desired operation. In examples where the MRM 760 is a passive device, the device is configured for a specific area and use pattern such that the directivity and beamforms are fixed. The FSS elements 752 are illustrated as divided into center cells 764 and edge portions 762, wherein each is specified according to location and configuration. This accounts for the different behavior of perimeter cells. There may be any number of rows and columns of center cells 764, and there may be multiple rows or columns of edge cells 762.

Signals are received at a transceiver unit 754, which contains a control channel receiver unit, that responds to the control signal and uses this information to reflect signals and information to various users within the environment. The MRMs 758, 760 may include other modules not shown, including a control signal unit, memory storage, power supply, along with the FSS elements 752.

Figure 8:
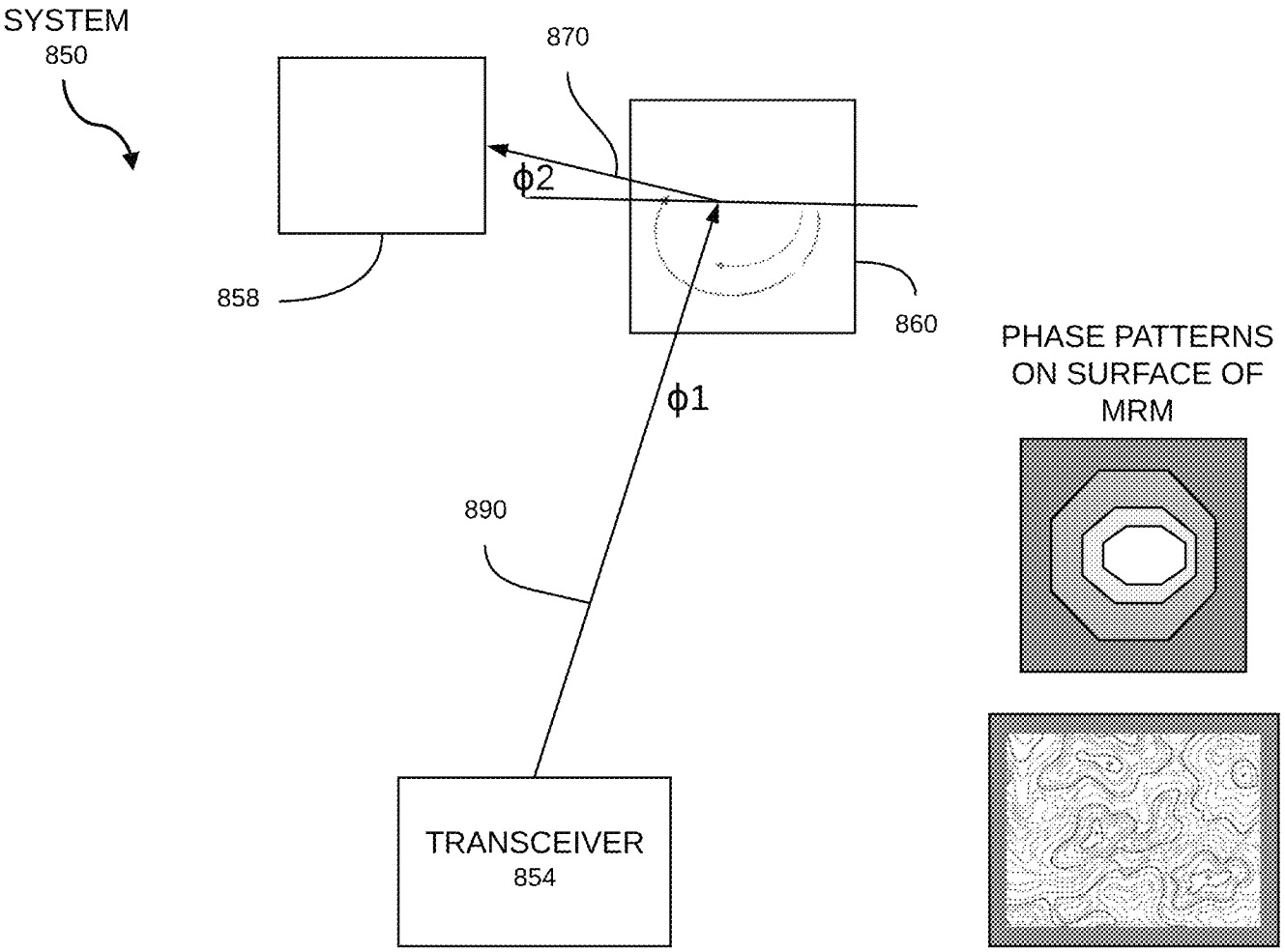

FIG. 8 illustrates the phase relationships of the signals from transceiver 854 and MRM 860. The transceiver sends signal 890 which is incident on MRM 860 at an angle $\phi_1$. The MRM 860 is configured to reflect that signal at angle $\phi_2$. The phase response of MRM 860 acts to change the phase of the incident signal to that of the reflected signal 870. This may be achieved in a variety of methods using FSS structures. Note that for MTM devices, each unit cell may have an individual behavior, wherein the composite behavior of MRM 860 in response to signals from transceiver 854 at phase angle $\phi_1$ is to shift the incident wave to phase angle $\phi_2$. The calculations may involve finding the difference between the 2 angles and/or other methods to determine relationship and adjustment.

Also illustrated are two phase pattern examples looking at the surface of the MRM 860 in the z-direction (coming out of the page), which is the direction of signal propagation. The different areas of the MRM 860 have different phase responses, which when acting together produce the desired EM beam form(s). The phase pattern may be a regularly defined shape, such as concentric shapes, and may be a continuous range of values. The phase pattern refers to the phase of signals that would be produced at an antenna, MRM or reflector structure if a transmission signal were input to the signal for transmission. The radiation pattern at the surface is determined by the configuration of the FSS, wherein the combined effect of an array of elements or a subarray of elements results in one or more lobes.

In the reflector applications discussed herein a major lobe is one that is directed from one reflector to another, while the minor lobes are the ones that are directed to cover the surrounding area. There may be one or more minor lobes, and depending on the space and equipment, there may be more than one major lobe. In a passive device, the configuration of the area is known ahead of time and the device is designed for a specific area and transmitter. In an active device, the device is designed for optimum performance in one direction but may be adjusted as needed through control of the FSS elements.

The examples provided herein of MRMs to extend the reach of transmission hubs, such as base stations. The MRMs may be designed and configured as passive devices that reflect incident signals or as active devices that receive control information from the transmission hub, and reflect transmissions in response to that control information. There are a variety of FSS designs that may be implemented in single or multiple layers, including MTM layers.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A wireless communications system, comprising:

a first meta-structure reflector module configured to receive a signal from a base station, the first meta-structure reflector module comprising an array of meta-structure cells positioned atop a layer of slotted transmission lines; and a second meta-structure reflector module configured to receive a reflection of the signal from the first meta-structure reflector module and reflect the received reflection into an angle different from the received reflection.

2. The wireless communications system of claim 1, wherein the first meta-structure reflector module further comprises a layer of metamaterial cells.

3. The wireless communications system of claim 2, wherein each metamaterial cell comprises a reactance control element.

4. The wireless communications system of claim 2, wherein the metamaterial cells comprise a plurality of center cells and a plurality of edge cells surrounding the plurality of center cells.

5. The wireless communications system of claim 4, wherein each of the plurality of center cells and each of the plurality of edge cells is configured to reflect a signal based on its location.

6. A wireless communications system for an indoor environment, comprising:

a transmitter positioned on a surface of the indoor environment and configured to transmit wireless signals at multiple frequencies; and a plurality of active meta-structure reflector modules positioned proximate to the transmitter, each meta-structure reflector module configured to receive a signal at an incident angle and reflect the signal at a reflection angle, wherein one reflector module of the plurality of active meta-structure reflector modules comprises an array of meta-structure cells positioned atop a layer of slotted transmission lines.

7. The wireless communications system of claim 6, wherein each of the plurality of active meta-structure reflector modules comprises an array of meta-structure cells.

8. The wireless communications system of claim 7, wherein each meta-structure cell comprises a reactance control module configured to generate a phase shift for the received signal to be reflected at the reflection angle.

9. The wireless communications system of claim 7, wherein the array of meta-structure cells is configured into a plurality of subarrays.

10. The wireless communications system of claim 9, wherein each subarray is configured to reflect signals at a specific angle.

11. The wireless communications system of claim 6, wherein the reflection angle is different from the incident angle.

12. The wireless communications system of claim 6, wherein the plurality of active meta-structure reflector modules comprise a stack of layers each comprising an active meta-structure reflector module.

13. A wireless communications network, comprising:

a first reflector module comprising a set of frequency selective elements and configured to receive and reflect a signal from a transmitter, the first reflector module further comprising an array of meta-structure cells positioned atop a layer of slotted transmission lines; and a second reflector module configured to receive a reflected signal from the first reflector module and further reflect the received reflected signal to a user equipment.

14. The wireless communications network of claim 13, wherein the set of frequency selective elements comprises metamaterial elements that are configured to reflect the signal into a plurality of reflected beams at a plurality of phase angles different from that of the signal.

15. The wireless communications network of claim 14, wherein each of the metamaterial elements comprises a reactance control element or a varactor.

16. The wireless communications network of claim 14, wherein the metamaterial cells comprise a plurality of center cells and a plurality of edge cells surrounding the plurality of center cells.

17. The wireless communications network of claim 16, wherein each of the plurality of center cells and each of the plurality of edge cells is configured to reflect a signal based on its location.

18. The wireless communications network of claim 13, wherein the second reflector module is configured to reflect the received reflected signal at an angle different from an incident angle of the received reflected signal.

19. The wireless communications network of claim 13, wherein the set of frequency selective elements comprises a first set of frequency selective elements and a second set of frequency selective elements, and wherein the first set of frequency selective elements is configured to reflect the signal at a first frequency and pass the signal through to the second set of frequency selective elements at a second frequency.

20. The wireless communications network of claim 13, wherein the first reflector module further comprises multiple substrate layers each comprising a subset of frequency selective elements from the set of frequency selective elements.

* * * * *